US006045056A

United States Patent [19]

Tardoni

[11] Patent Number: 6,045,056

[45] Date of Patent: Apr. 4, 2000

[54] OPTIMIZED SPRAY DEVICE (OSD) APPARATUS AND METHOD

[75] Inventor: James E. Tardoni, Johnstown, Pa.

[73] Assignee: Concurrent Technologies Corporation, Johnstown, Pa.

[21] Appl. No.: 08/996,622

[22] Filed: Dec. 23, 1997

Related U.S. Application Data

[60] Provisional application No. 60/034,184, Dec. 26, 1996.

[51] Int. Cl.[7] ..... B05B 7/04

[52] U.S. Cl. ..... 239/8; 239/61; 239/124; 239/398; 427/8; 118/300; 118/712

[58] Field of Search ..... 239/61, 63, 67, 239/73, 1, 124, 127, 8, 341, 351, 434, 434.5, DIG. 14, 398; 118/300, 697, 704, 712; 427/8

[56] References Cited

U.S. PATENT DOCUMENTS

| | | | |
|---|---|---|---|
| 3,824,040 | 7/1974 | Aronson | 239/127 X |
| 3,949,053 | 4/1976 | Gentry et al. | 423/210 |
| 4,000,856 | 1/1977 | Quarve et al. | 239/332 |
| 4,278,205 | 7/1981 | Binoche . | |
| 4,542,045 | 9/1985 | Boone et al. | 427/236 |
| 4,569,480 | 2/1986 | Levey . | |
| 4,915,599 | 4/1990 | Katsuyama et al. . | |
| 4,923,743 | 5/1990 | Stewart, Jr. | 427/288 |
| 4,986,659 | 1/1991 | Bachalo . | |
| 5,004,159 | 4/1991 | Kistner . | |
| 5,054,687 | 10/1991 | Burns et al. . | |
| 5,058,805 | 10/1991 | Anderson et al. . | |
| 5,074,237 | 12/1991 | Ogasawara . | |
| 5,100,060 | 3/1992 | Haferkorn . | |
| 5,119,992 | 6/1992 | Grime . | |
| 5,135,172 | 8/1992 | Toth . | |
| 5,218,211 | 6/1993 | Cresswell et al. . | |
| 5,221,026 | 6/1993 | Williams | 222/144.5 |
| 5,228,622 | 7/1993 | Murphy et al. | 239/127 X |
| 5,240,181 | 8/1993 | Uribe . | |
| 5,284,299 | 2/1994 | Medlock . | |
| 5,333,506 | 8/1994 | Smith et al. . | |
| 5,388,761 | 2/1995 | Langeman | 239/61 X |
| 5,452,855 | 9/1995 | Keller . | |
| 5,471,298 | 11/1995 | Moriya . | |
| 5,478,014 | 12/1995 | Hynds . | |
| 5,546,183 | 8/1996 | Fegley et al. . | |
| 5,561,515 | 10/1996 | Hairston et al. . | |
| 5,601,235 | 2/1997 | Booker et al. | 239/63 X |
| 5,618,347 | 4/1997 | Clare et al. | 239/124 X |
| 5,619,324 | 4/1997 | Harvill et al. . | |

*Primary Examiner*—Andres Kashnikow
*Assistant Examiner*—Steven J. Ganey
*Attorney, Agent, or Firm*—Draughon P.A.; Mark J. Young

[57] ABSTRACT

A method and apparatus for efficiently applying liquid coatings to a workpiece. The apparatus is a compressed air spray system tailored to achieve a desired transfer efficiency (TE) by controlling atomization. Liquid and pressurized air are supplied to a spray applicator. The atomized spray is applied to the workpiece. Atomization and TE, as well as associated fluid flow parameters, are measured at various gas pressures while maintaining a constant liquid flow rate. A graphical representation of the relationship between atomization and TE is produced. An optimized atomization corresponding to a desired TE is determined from the graphical representation of atomization and TE. The fluid flow parameters corresponding to the optimized atomization are set and regulated to produce the optimized atomization, thereby optimizing transfer efficiency.

25 Claims, 5 Drawing Sheets

OPTIMIZED SPRAY DEVICE (OSD) APPARATUS AND METHOD

This Application claims the benefit of U.S. Provisional Application Ser. No. 60/034,184, filed Dec. 26, 1996.

BACKGROUND

The present invention relates to an apparatus and method for an optimized compressed air system used to apply liquid coatings while producing a high quality film coating.

Industries that apply liquid coatings cover a wide range of products including automotive, containers, furniture, machinery, aircraft, electronics, and shipbuilding. Approximately 1 billion gallons of liquid coatings are applied annually in the United States. About 10 percent of these liquid coatings are applied using conventional low-volume, high pressure, compressed air spray (CAS) systems.

CAS systems have been in use for over 40 years. To atomize a liquefied stream of paint, CAS systems employ high pressure (40–70 pounds per square inch [psi]) air. The high energy air stream is mixed with paint, producing an atomization that is generally very fine and easily applied. Thus, the system is capable of producing a very good finish with high quality visual characteristics while easily covering a large surface area in a relatively short time span.

A disadvantage associated with CAS systems is that the high degree of atomization produces a very fine spray that is highly susceptible to overspray. Such spray characteristics result in more paint being used to compensate for overspray waste and a relatively low transfer efficiency (TE) of approximately 20 to 40 percent (TE=percentage of coating gained on a sprayed part relative to the weight of coating sprayed).

Another disadvantage associated with CAS systems concerns volatile organic compounds (VOC) emissions. The consistency of most coatings is too thick for effective spray application. Thinners or solvents are introduced to decrease viscosity and thereby facilitate spray application. Examples of such thinners and solvents include petroleum spirits, mineral spirits, toluene, xylene, solvent naphtha, esters, alcohols and ketones. The high degree of atomization and relatively low transfer efficiency associated with CAS systems is conducive to relatively high levels of VOC emissions from the solvents and thinners.

Concern over VOC emissions and paint overspray has lead to the development of High Volume Low Pressure (HVLP) spraying systems. An HVLP system delivers paint using a large volume of air (100 cfm) while operating at a relatively low air pressure, typically between 3 to 6 psi and not exceeding 10 psi. The low pressure high volume design of the HVLP system produces a transfer efficiency as high as 85% due mainly to the larger droplet size distributions of the spray. Large droplets and high transfer efficiency translate into reduced VOC emissions and paint consumption.

Environmental and health concerns over VOC emissions have led some local governments to require the use of HVLP spray systems. Southern California and the San Francisco Bay area each promulgated rules requiring the use of HVLP spray systems while applying refinish materials.

HVLP systems have several disadvantages. HVLP paint spray systems use large volumes of air and energy in comparison to CAS systems. HVLP systems also require most coatings to be greatly thinned to produce an acceptable spray. If excessive thinning is required, an operator may need to apply multiple coats to produce a desired finish.

High viscosity paints such as latex may be too thick for an HVLP system. HVLP systems are also inappropriate for spraying large areas since the rate of application is relatively low in comparison to compressed air systems. Furthermore, the coating quality generated from HVLP systems, when operated at recommended settings is unsatisfactory to many users. As a result, many commercial spray coating facilities compensate by increasing the air flow rate above the recommended settings in an attempt to improve atomization and coating quality. Such elevated air flow rates increase overspray, waste, and energy usage.

Thus, there is a continuing need for an optimized compressed air spray system which can achieve the high transfer efficiencies of an HVLP spray system while producing a high quality coating.

SUMMARY

An object of the present invention is to provide an apparatus and method for efficiently applying liquid coatings. The OSD apparatus is a compressed air spray (CAS) system tailored to achieve a desired transfer efficiency by controlling atomization. Generally, the desired transfer efficiency is the maximum transfer efficiency which correlates to acceptable coating qualities and spray characteristics. Another object of the present invention is to enable a CAS system to produce a transfer efficiency substantially equivalent to an HVLP system while delivering superior coating quality and application rate, as well as energy savings and reduced VOC emissions.

Atomization and transfer efficiency are interrelated. For any given atomization there is a corresponding transfer efficiency. This relationship is independent of any spray system or spray gun configuration. A cross correlation between transfer efficiency and atomization can be made utilizing gas pressure as a reference. For example, gas pressure X corresponds to transfer efficiency Y and atomization Z. The plotted graph reveals a curve which is independent of the spray system used. The cross correlated data reveals that as the average size of the droplets within the atomized spray increases, the transfer efficiency also increases. Using the relationship between transfer efficiency and atomization, the OSD apparatus of the present invention is capable of producing atomization corresponding to a desired transfer efficiency.

The OSD apparatus includes a CAS system having a liquid system side and a gas system side. Fluid flow parameters are monitored and controlled on both sides. The liquid system side of the apparatus preferably includes a liquid pot, a metering pump with time control and a mass flow meter. The gas system side of the apparatus preferably includes a gas source, a pressure regulator, a manifold with pressure and temperature instrumentation, a flow rate measurement and control device and pressure instrumentation. The flow parameters of air and liquid are preferably monitored and controlled using a programmable logic controller (PLC) to produce atomization which corresponds to a desired transfer efficiency. Both the liquid and gas systems connect to a spray applicator.

DESCRIPTION

Figure 1:
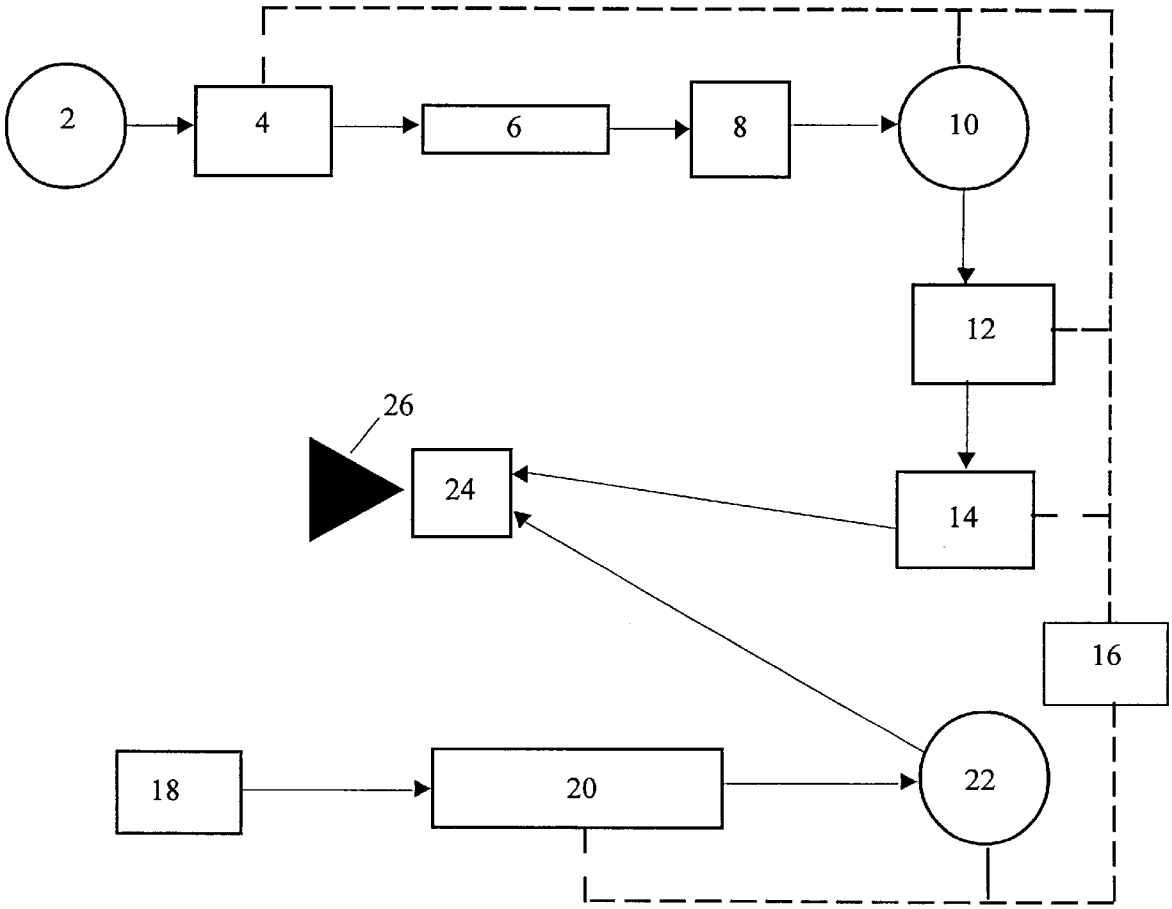
FIG. 1 is an overview of the Optimized Spray Device (OSD), including a programmable logic controller (PLC)

The Optimized Spray Device (OSD) is designed to achieve optimized atomization. The device can produce atomization corresponding to a desired transfer efficiency. Generally, the desired transfer efficiency is the maximum transfer efficiency which correlates to acceptable coating qualities and spray characteristics. Based on predetermined atomization and transfer efficiency data and corresponding fluid flow rates and pressures, the fluid flow parameters of the OSD are set to produce the optimized atomization corresponding to the desired transfer efficiency. Thus, an OSD is capable of delivering a spray which produces a high quality coating at an acceptable application rate while reducing waste.

The OSD includes a CAS system and means for controlling fluid flow parameters. The fluid flow parameters are set to produce atomization corresponding to the desired transfer efficiency.

The OSD is superior to an HVLP system in terms of efficiency and performance. An OSD can surpass an HVLP's transfer efficiency while producing better quality coatings at higher application rates and delivering energy savings.

Table 1 illustrates the superior coating quality of an OSD as compared to an HVLP system at the same transfer efficiency. The OSD out-performed the HVLP system by 250% in the Mandrel Bend Test. The Mandrel Bend Test measures the length of the coating tear after the test panel has been bent 180 degrees. The OSD also achieved superior results over the HVLP system in the salt spray corrosion tests.

TABLE 1

Product Analysis Report - Performance Comparison of Cold Rolled Steel Pretreated Panels Coated with the Optimized CAS and HVLP Systems

| Sample ID | Test Parameter | Test Result | Test Method |
|---|---|---|---|
| HVLP 95-4005-*P- | Gloss at 60° | 96.5 | ASTM B499 |
| | Reverse Impact | Pass at 46 inch lbs. | ASTM D522 |
| HVLP 95-4006-P | Mandrel Bend - ⅛" | Fail - ⅝th inch from small end of the cone | ASTM D522 |
| | MEK Rub | No effect after 50 double rubs | ASTM D4852 |
| HVLP 95-4007-P | Salt Spray Corrosion | Heavy unscribed surface corrosion | ASTM B117 |
| HVLP 95-4009-P | Pencil Hardness | >8 H beyond capabilities of test | ASTM D3363 |
| | Intercoat Adhesion | No effect after 50 double rubs | ASTM D3359 |
| OPCAS 95-4000-P | Gloss at 60° | 96.5 | ASTM B499 |
| | Reverse Impact | Pass at 68 inch lbs. | ASTM D522 |
| OPCAS 95-4001-P | Mandrel Bend - ⅛" | Fail - ¼ inch from small end of cone | ASTM D522 |
| | MEK Rub | No effect after 50 double rubs | ASTM D4852 |
| OPCAS 95-4002-P | Salt Spray Corrosion | Traces of unscribed surface corrosion | ASTM B117 |
| OPCAS 95-4002-P | Pencil Hardness | >8 H beyond capabilities of test | ASTM D3363 |
| | Intercoat Adhesion | No effect after 50 double rubs | ASTM D3359 |

Liquid transfer is the process whereby a fraction of the atomized liquid is deposited on the workpiece under the influence of aerodynamic forces, and in the case of electrostatic systems, electrostatic forces. The balance of the atomized liquid is swept around the workpiece by the airflow and forms overspray. The liquid transfer is best described in terms of atomization performance and drop transfer efficiency performance. The transfer efficiency, TE, is given by:

$$TE = \int_{D\min}^{D\max} T(D)q(D)dD$$

The drop transfer efficiency function, T(D), represents the fraction of drops of diameter D that deposit on the workpiece. The atomization probability density function, q(D), represents the probability of atomizing a liquid volume into drops within the diameter range.

The transfer efficiency equation shows that atomization and drop transfer influence transfer efficiency. The atomization process primarily defines the droplet size distribution in a compressed air system. In the case of air spray guns, a high speed annular flow of air facilitates atomization of a center liquid jet. The resulting shear between the air and liquid disrupts the liquid flow into shreds and ligaments which rapidly collapse into spherical drops due to surface tension.

Atomization performance can be quantified in terms of a measured drop-size distribution using the atomization probability density function for a volume, q(D). Integration of this function over a finite range of diameters yields the probability of atomizing a liquid volume into drops within that diameter range.

In the case of commercial paint atomizers, the drop-size distribution is quite broad (ranging from less than 1 $\mu$m to greater than 100 $\mu$m). The span or spread of the distribution is influenced most strongly by atomizer type and paint formulation. The distributions produced by rotary and supercritical atomizers are generally narrower than those produced by air-spray or airless atomizers. The narrowness is attributed to the variance in dominant atomization mechanisms for each type. Furthermore, paints exhibiting time dependent behavior tend to produce narrower drop-size distributions.

For a particular type of atomizer (air, airless, rotary or supercritical) and paint formulation, the atomization mechanism is qualitatively consistent and there is little variation in the spread of the distribution. Consequently, it is common practice to characterize performance of a particular type of atomizer in terms of mean values of the distribution. The most common is the Sauter Mean Diameter (SMD) which exhibits the same surface to volume ratio as the atomized spray.

The atomization performance, q(D), of an air spray applicator is influenced by (1) the gun configuration, (2) the flow rates and (3) the liquid formulation. The gun consists of a fluid nozzle and an air cap. Manufacturers generally supply various fluid nozzle and air cap combinations for a particular gun. Atomization performance is strongly influenced by these combinations.

Three flow rates affect atomization. The flow rates are the liquid, atomizing air and shaping air. The atomizing and shaping air may be supplied independently to the gun, which allows for excellent control. Alternatively, a common air supply may be split in the body of the applicator with a simple valve arrangement. The atomizing air flow rate has the strongest effect on the atomization performance. The shaping air flow rate has the strongest effect on the pattern shape. The liquid flow rate has the strongest effect on the rate of liquid deposition. The effects of shaping air and liquid flow rates on atomization are secondary.

Liquid formulation also affects atomization. The effect of liquid formulation on atomization is critical. Even relatively small changes in solvent concentration can affect not only the mean values but also the width of the drop-size distribution.

The drop transfer efficiency, T(D), is influenced by the gun configuration and the geometry of the workpiece. The drop transfer efficiency is controlled by the structure of the air flow between the applicator and workpiece. The basic gun design and fluid nozzle and air cap combination establish the initial structure of the air flow between the applicator and workpiece. Of critical importance is the width of the spray along the minor axis of the spray pattern since most of the spray flows parallel to the minor axis. Air spray guns generally produce an elliptical spray pattern. The major axis runs the length of the ellipse between the extremities. The minor axis, perpendicular to the major axis, defines the narrow width of the spray pattern. The structure of the flow near the workpiece is established by the near nozzle flow structure and the shape of the workpiece. In general, T(D) increases as the width of the spray in the minor axis decreases, as the separation distance between the applicator and workpiece decreases, and as the size of the workpiece increases up to a critical value.

Variations in paint and air flow rates have little effect on drop transfer efficiency. The basic structure of the flow is established by the nozzle and workpiece geometry and is largely unaffected by the air and liquid flow rates. Flow rates do affect the absolute velocity and consequently the atomization. However, the basic flow structure is largely unaffected by the flow rates. An increase in air velocity around the workpiece (which tends to decrease T(D)) is offset by an increase in the initial momentum imparted to the drops near the nozzle and directed towards the workpiece (which tends to increase T(D)). The net effect on T(D) of increasing the air flow rate is therefore small.

Similar to air flow rate, liquid formulation has little effect on flow structure and hence on T(D). This is in sharp contrast to the effect of liquid formulation on atomization performance, q(D). Indeed, both air flow rate and liquid formulation do have substantial influence on TE through atomization performance, q(D).

Liquid spray droplet size influences both transfer efficiency and coating quality. Transfer efficiency is a function of droplet size. The efficiency drops off rapidly as droplet size decreases. Indeed, small droplets are conducive to overspray. Concomitantly, liquid spray droplet size affects coating uniformity and film quality. Large droplet size often leads to poor uniformity and film quality. Long wavelength, small amplitude disturbances on the coating surface commonly referred to as "orange peel" are attributed to large droplet size. Conversely, dry defects (e.g., granular-like appearance on the coating surface) are associated with small droplet size. An optimized spray exhibits a high TE while producing a high quality coating.

The term "air" is defined as being synonymous with the term "gas" and is intended to encompass the defined meanings of both terms. Thus, the term "air" would encompass the mixture of atmospheric gases such as nitrogen, oxygen, hydrogen, carbon dioxide and argon and all other gases and mixtures thereof. The term "air" is chosen because the term more fully describes the preferred gas used in aiding the atomization process used in the preferred embodiment.

The OSD apparatus is comprised of a CAS system and means for controlling fluid flow parameters. The CAS system includes an air system side and a liquid system side. The air system supplies atomization and shaping air to a spray applicator. The liquid system delivers liquid to the spray applicator.

Referring to FIG. 1, an air supply 2 introduces compressed air into the air system through an actuated pressure regulator 6. An incoming pressure instrument 4 can be fluidly connected between the air supply 2 and the pressure regulator 6. The incoming pressure instrument 4 monitors the initial air pressure before the air enters the actuated pressure regulator 6, but the incoming pressure instrument 4 is not essential to the practice of the present invention. The actuated pressure regulator 6 controls the pressure of the air flowing into a manifold 8. The manifold 8 is fluidly connected to the actuated pressure regulator 6. The manifold 8 equalizes the air pressure before the air enters a flow rate control and measurement instrument 10. The present invention may also be operated without the manifold 8 and flow rate control and measurement instrument 10. An actuated control valve 12 is fluidly connected to the flow rate control and measurement instrument 10 and an outgoing pressure measuring instrument 14. The actuated control valve 12 is used to adjust the air mass flow rate and pressure before the air is released to a spray applicator 24. The outgoing pressure measuring instrument 14 monitors the gas differential pressure across the spray applicator 24.

The liquid system preferably begins at a liquid pot 18. The liquid pot 18 stores a volume of liquid to be atomized by the spray applicator 24. Other storage devices or liquid supply means may also be used in place of the liquid pot 18. The liquid is delivered and controlled by a metering pump 20. The metering pump 20 inlet is connected to the liquid pot 18 by a hose or pipe and the outlet is connected to a mass flow meter 22. The mass flow meter 22 monitors the mass flow rate of liquid to the spray applicator 24. The spray applicator 24 is fluidly connected to the mass flow meter 22. The spray applicator 24 facilitates atomization 26 by introducing the air to the liquid.

Referring to FIG. 1, predetermined values for fluid flow parameters, namely, air pressure and flow rate and liquid flow rate, are logged into a programmable logic controller (PLC) 16. The logged values correspond to an optimized atomization and desired transfer efficiency for the OSD. The PLC is electrically connected to the incoming pressure measurement instrument 4, flow rate control and measurement instrument 10, actuated control valve 12, outgoing pressure measurement instrument 14, metering pump 20 and mass flow meter 22. The PLC 16 monitors air pressure and flow rate via the flow rate control and measurement instrument 10 and incoming and outgoing pressure measurement instrument 14. The PLC 16 adjusts the actuated control valve 12 to maintain outgoing air pressure and flow rate equivalent to the logged values. The PLC 16 also monitors the liquid flow rate via the mass flow meter 22 and adjusts the metering pump 20 to maintain liquid flow rate equivalent to the logged values.

Figure 2:
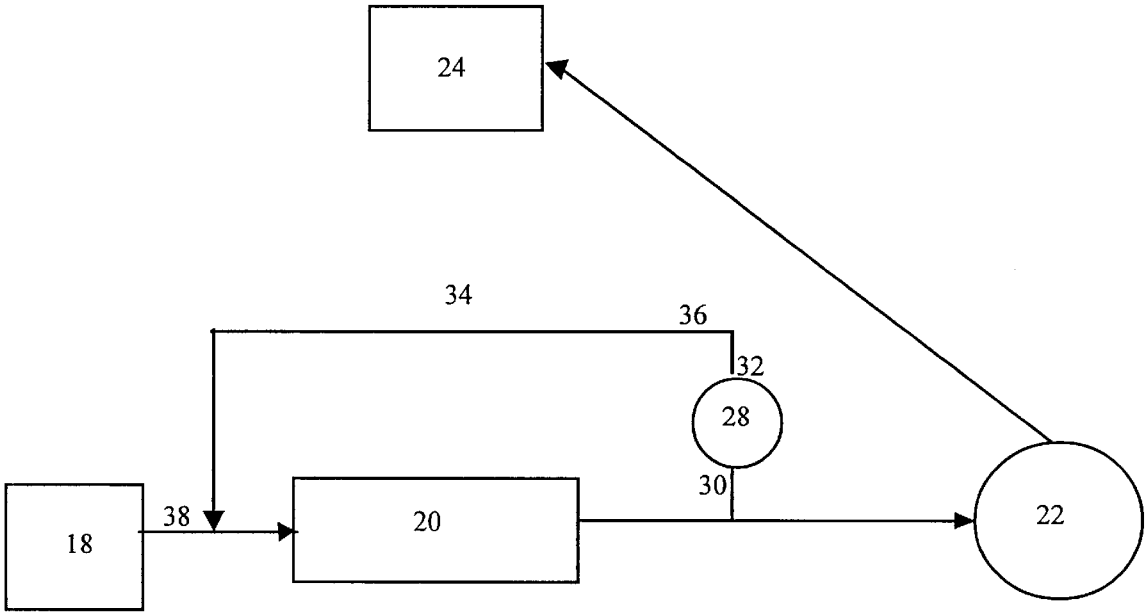
FIG. 2 depicts a Liquid Bypass System.

An alternative embodiment may include a liquid bypass system as illustrated in FIG. 2. The liquid bypass system enables the metering pump 20 to operate continuously even when the spray applicator 24 is not triggered. The liquid bypass system includes a pressure relief valve 28, having an inlet 30 and outlet 32, and a bypass line 34, having an inlet 36 and outlet 38. The inlet 30 of the pressure relief valve 28 is connected to the OSD between the metering pump 20 and the spray applicator 24. The outlet 32 of the pressure relief valve 28 is connected to the inlet 36 of the bypass line 34. The outlet 38 of the bypass line 34 is connected to either the liquid pot 18 or the OSD between the metering pump 20 and the liquid pot 18. Thus, when the spray applicator 24 is not triggered, pressure builds up and causes the pressure relief valve 28 to open. Once the pressure relief valve 28 opens, liquid enters the bypass line and flows back into the liquid pot 18 or the metering pump 20. When the spray applicator 24 is triggered, the pressure drops and the pressure relief valve 28 closes allowing the liquid to flow freely to the spray applicator 24.

Figure 3:
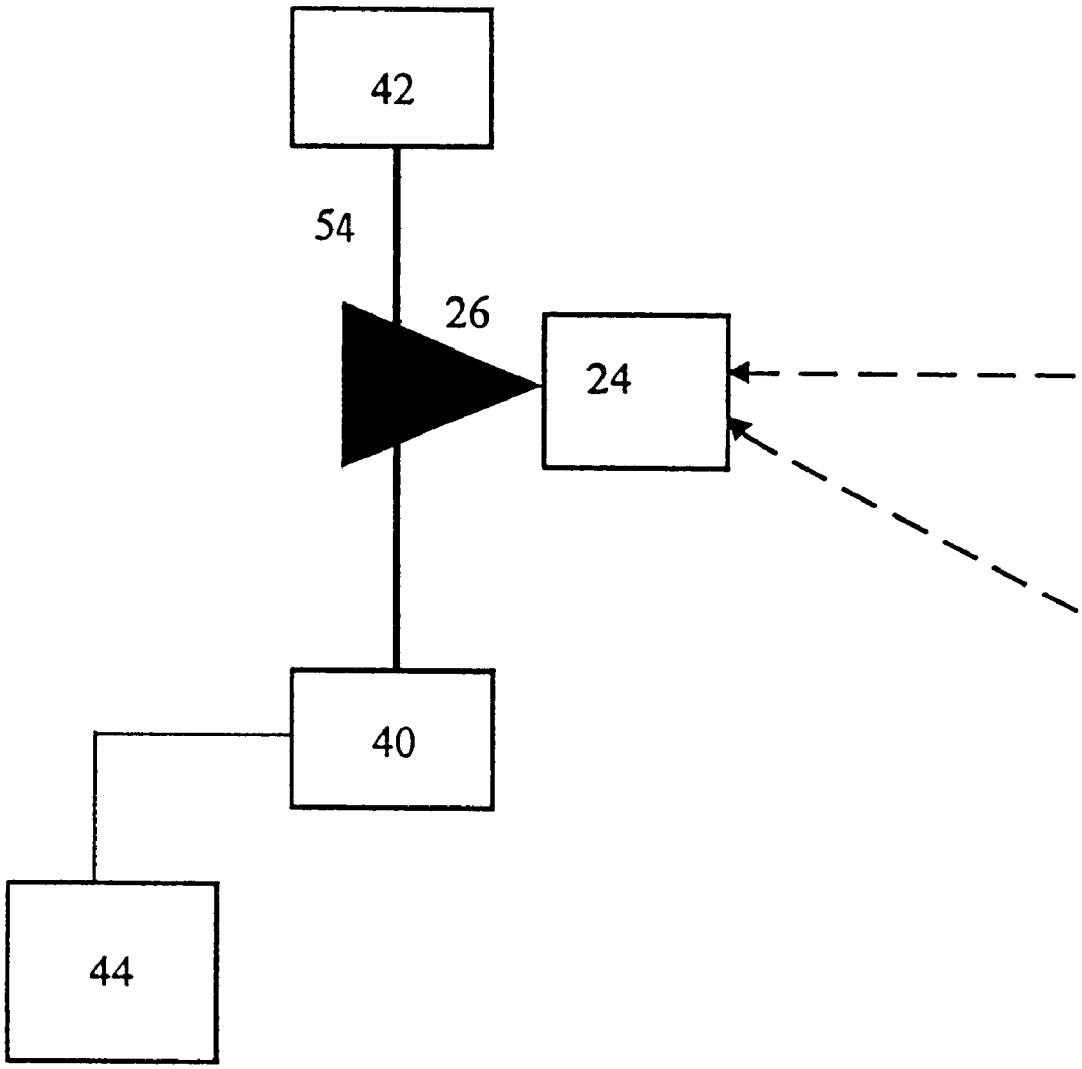
FIG. 3 depicts a Laser Particle Sizing Apparatus.

The predetermined values for the fluid flow parameters are obtained experimentally using a laser particle sizing apparatus, as illustrated in FIG. 3, and the compressed air spray system, as illustrated in FIG. 1. However, the programmable logic controller 16 is not necessary for obtaining the values.

The laser particle sizing apparatus measures atomization characteristics preferably using the Fraunhofer diffraction technique. Other methods may also be used in determining atomization, such as a Phase Doppler Particle Analysis (PDPA). PDPA systems are not preferred, since the systems are larger, bulkier and much more complicated to operate and set-up than the Fraunhofer diffraction system. Also, the cost of a PDPA system greatly exceeds that of the Fraunhofer system.

Referring to FIG. 3, the laser particle sizing apparatus includes three components: a transmitter 40, a receiver 42, and a computer 44. The transmitter 40 houses the laser. The receiver 42 includes a receiving lens, receiving plate and housing with horizontal and vertical adjustments. The receiver 42 can be fitted with different lenses depending on the range of droplet sizes to be measured. The Malvern Particle Sizer System manufactured by Malvern Instruments of Southborough, Mass. is an example of a suitable transmitter and receiver.

Figure 4:
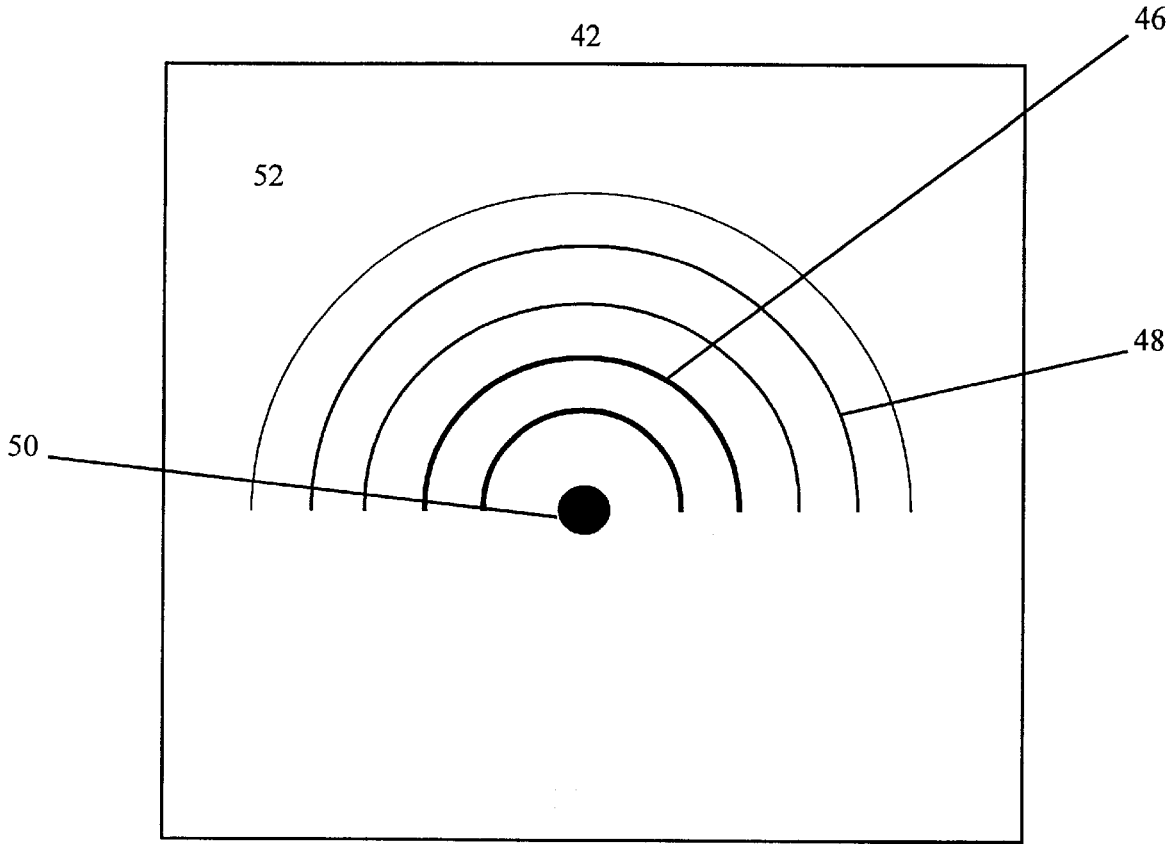
FIG. 4 depicts a Receiving Plate of a Laser Receiver.

The preferred Fraunhofer diffraction system includes a receiver 42 (as depicted in FIG. 4) having a receiving plate 52 with a series of light energy sensitive diodes 46–48 including a single center diode 50. When a droplet enters the laser path 54 (as depicted in FIG. 3), a portion of the laser light energy is diffracted. Smaller droplets diffract the light energy at large angles and, therefore, the receiving plate 52 receives the diffracted light energy at the outer diodes 46–48. Larger droplets diffract the light energy at smaller angles and, therefore, the diodes closer to the center diode 50 receive the diffracted light energy. Laser diode response signals are then sent to the computer 44. The computer 44 collects the response signal data, converts the data into droplet size information and computes the mean droplet size, droplet size range, droplet size distribution and preferably Sauter Mean Diameter (SMD).

The Sauter Mean Diameter $D_{32}$ can be obtained by combining the volume mean diameter $D_{30}$ and the surface mean diameter $D_{20}$ such that $D_{32}=D_{30}^3/D_{20}^2$. The Sauter Mean Diameter is defined as the diameter of a drop having the same volume/surface ratio as the entire spray. The Sauter equation provides a convenient and fairly accurate representation of the atomized spray. Although the Sauter Mean Diameter equation has been described as the preferred method of characterizing the atomized spray, other equations or representations may also be used to describe the spray.

The predetermined values for the fluid flow parameters of the OSD are determined using the following steps. First, atomization 26 is measured at various air pressures while maintaining a constant liquid flow rate. A graphical representation of the relationship between atomization 26 and air pressure can be produced. Corresponding liquid and air flow rates are also recorded. Next, transfer efficiencies should be experimentally determined using the standards of the American Society of Testing and Materials (ASTM), and preferably the standard issued under the fixed designation D 5327, Standard Practice for Evaluating and Comparing Transfer Efficiency Under General Laboratory Conditions. The transfer efficiencies are also determined at various gas pressures while maintaining a constant liquid flow rate. Concomitantly, spray characteristics, such as application rate, and coating qualities are evaluated.

The optimized atomization is the atomization corresponding to the desired transfer efficiency, using air pressure as a reference. Generally, the desired transfer efficiency is the maximum transfer efficiency which correlates to acceptable coating qualities and spray characteristics. The values for the fluid flow parameters are the air and liquid flow rates and air pressure which correspond to optimized atomization and desired transfer efficiency.

Figure 5:
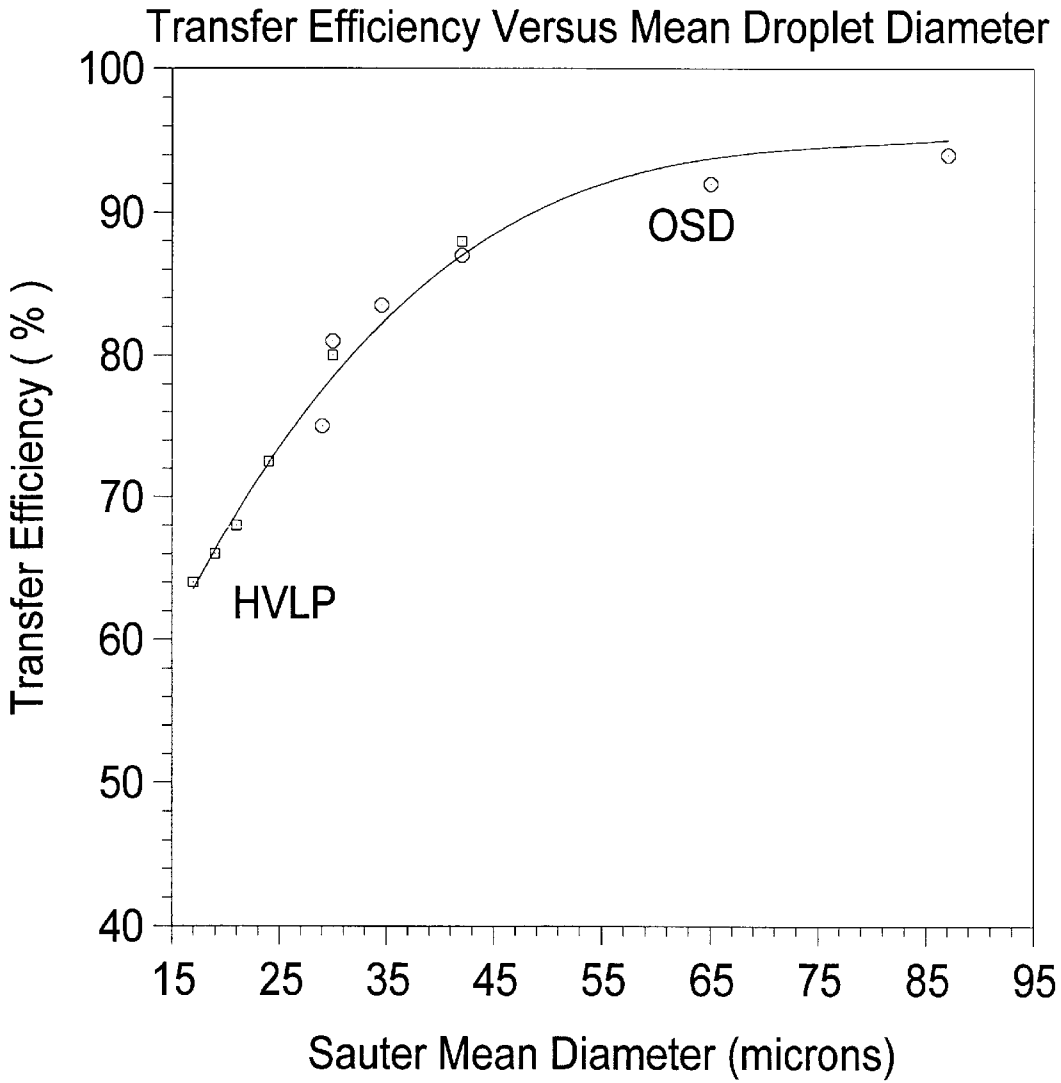
FIG. 5 is a graph depicting cross-correlated transfer efficiency and atomization data for an HVLP and CAS system.

The relationship between transfer efficiency and gas pressure can also be graphically represented and used as a reference. In general, for any given atomization there is a corresponding transfer efficiency, and this relationship is independent of the spray system or spray gun configuration, as illustrated in FIG. 5. The FIG. 5 graph illustrates a curve whose coordinates are expressed as a cross correlation between transfer efficiency and atomization utilizing gas pressure as a reference, so that a gas pressure X corresponds to a transfer efficiency Y and an atomization Z. While two different spray systems were used, the experimental results for both systems follow the same curve. Therefore, once a graph is completed for a range of transfer efficiencies and corresponding atomizations there is no longer a need to experimentally measure the transfer efficiency for the tested liquid coating or compounds having very similar characteristics.

The predetermined values may also be determined using a graph of cross-correlated data compiled from experimental results. Knowing the fluid flow parameters corresponding to optimized atomization and desired transfer efficiency, the system parameters can then be set to produce the optimized spray, either manually or through the use of a PLC.

What is claimed is:

1. A method of operating a compressed air spray device comprising the steps of:

(a) supplying air to a spray applicator, the air having a pressure and a flow rate;

(b) supplying a liquid to the spray applicator, the liquid having a flow rate;

(c) selecting a desired transfer efficiency;

(d) determining an optimized atomization corresponding to the desired transfer efficiency;

(e) regulating the pressure and flow rate of the air and the flow rate of the liquid, according to the following equation, for producing an atomized spray having the optimized atomization corresponding to the desired transfer efficiency:

$$TE = \int_{D\min}^{D\max} T(D)q(D)dD$$

Wherein:

TE is the transfer efficiency,

T(D) is a drop transfer efficiency function, q(D) is an atomization probability density function, Dmax is a maximum droplet diameter for the atomized spray, and Dmin is a minimum droplet diameter for the atomized spray; and (f) applying the atomized spray to a workpiece.

2. The method of operating a compressed air spray device as recited in claim 1, wherein the atomization probability density function q(D) is determined according to the configuration of the spray applicator, the liquid and air flow rates, and the formulation of the liquid.

3. The method of operating a compressed air spray device as recited in claim 1, wherein the drop transfer efficiency function T(D) is determined according to the configuration of the spray applicator and the geometry of the workpiece.

4. The method of operating a compressed air spray device as recited in claim 1, wherein the step of determining the optimized atomization corresponding to the desired transfer efficiency includes:

(a) experimentally measuring an atomization and corresponding liquid and air flow rates for each of a plurality of air pressures while maintaining a constant liquid flow rate, producing atomization data;

(b) experimentally measuring a transfer efficiency for each of a plurality of air pressures while maintaining a constant liquid flow rate, producing transfer efficiency data;

(c) cross correlating the atomization and transfer efficiency data using the air pressures as a reference; and (d) determining the optimized atomization from the cross-correlated data, the optimized atomization corresponding to the desired transfer efficiency.

5. The method of operating a compressed air spray device as recited in claim 4, wherein the optimized atomization produces the desired transfer efficiency, the desired transfer efficiency having acceptable coating qualities and spray characteristics.

6. The method of operating a compressed air spray device as recited in claim 1, further including predetermined values correlating to the optimized atomization, the predetermined values including a predetermined air pressure and a predetermined liquid flow rate wherein the air pressure and liquid flow rate are regulated to correspond with the predetermined air pressure and liquid flow rate.

7. The method of operating a compressed air spray device as recited in claim 6, wherein the optimized atomization produces the desired transfer efficiency, the desired transfer efficiency having acceptable coating qualities and spray characteristics.

8. The method of operating a compressed air spray device as recited in claim 6, further including inputting the predetermined values into a programmable logic controller, the controller regulating the air pressure and the air and liquid flow rates.

9. The method of operating a compressed air spray device as recited in claim 8, wherein the optimized atomization corresponds to a transfer efficiency of greater than 50% and the predetermined value for the air pressure is greater than 35 psi.

10. The method of operating a compressed air spray device as recited in claim 8, wherein the optimized atomization corresponds to a transfer efficiency of greater than 80% and the predetermined air pressure is greater than 35 psi.

11. The method of operating a compressed air spray device as recited in claim 8, wherein the step of regulating the air pressure of the air supplied to the spray applicator includes:

(a) controlling the flow rate and pressure of the supplied pressurized air to produce an actuated pressurized air;

(b) measuring the pressure of the actuated pressurized air; and (c) delivering the actuated pressurized air to the spray applicator.

12. The method of operating a compressed air spray device as recited in claim 8, wherein the step of regulating the liquid flow rate includes:

(a) delivering a volume of liquid to the spray applicator; and (b) measuring the liquid flow rate as the volume of liquid is delivered to the spray applicator.

13. The method of operating a compressed air spray device as recited in claim 8, further including the steps of:

(a) determining the pressure of the liquid being delivered to the spray applicator; and (b) diverting the liquid from the spray applicator once the determined pressure exceeds a preset level.

14. A method of operating a compressed air spray device comprising the steps of:

(a) supplying air to a spray applicator, the air having a pressure and a flow rate;

(b) supplying a liquid to the spray applicator at a certain pre-selected flow rate;

(c) selecting a desired transfer efficiency;

(d) determining an optimized atomization corresponding to the desired transfer efficiency;

(e) regulating the pressure and flow rate of the air supplied to the spray applicator to produce an atomized spray having the optimized atomization; and (f) applying the atomized spray to a workpiece.

15. The method of operating a compressed air spray device as recited in claim 14, wherein the step of determining the optimized atomization corresponding to the desired transfer efficiency includes:

(a) experimentally measuring an atomization and a transfer efficiency for each of a plurality of air pressures while maintaining a constant liquid flow rate;

(b) cross correlating the atomization and transfer efficiency data using the air pressures as a reference; and (c) determining the optimized atomization from the cross-correlated data, the optimized atomization corresponding to the desired transfer efficiency.

16. The method of operating a compressed air spray device as recited in claim 15, wherein the pressure and flow rate of the air are regulated, according to the following equation, to produce the optimized atomization corresponding to the desired transfer efficiency:

$$TE = \int_{D\min}^{D\max} T(D)q(D)dD$$

(a) TE is the transfer efficiency;

(b) T(D) is the drop transfer efficiency function, T(D) being determined according to the configuration of the spray applicator and the geometry of the workpiece;

(c) q(D) is the atomization probability density function, q(D) being determined according to the configuration of the spray applicator, the liquid and air flow rates, and the formulation of the liquid;

(d) Dmax is the maximum droplet diameter for the atomized spray; and (e) Dmin is the minimum droplet diameter for the atomized spray.

17. An optimized spray device comprising:

(a) a spray applicator;

(b) means for supplying air to a spray applicator, the air having a pressure and a flow rate;

(c) means for supplying a liquid to the spray applicator, the liquid having a flow rate;

(d) means for selecting a desired transfer efficiency;

(e) means for determining an optimized atomization corresponding to the desired transfer efficiency; and (f) means for regulating the pressure and flow rate of the air and the flow rate of the liquid supplied to the spray applicator to produce an atomized spray having the optimized atomization.

18. An optimized spray device as recited in claim 17, wherein the means for determining the optimized atomization corresponding to the desired transfer efficiency further comprises:

(a) means for experimentally measuring an atomization and corresponding liquid and air flow rates for each of a plurality of air pressures while maintaining a constant liquid flow rate, producing atomization data;

(b) means for experimentally measuring a transfer efficiency for each of a plurality of air pressures while maintaining a constant liquid flow rate, producing transfer efficiency data; and (c) means for cross correlating the atomization and transfer efficiency data using the air pressures as a reference, the optimized atomization being determined from the cross-correlated data as the atomization corresponding to the desired transfer efficiency.

19. An optimized spray device as recited in claim 18, wherein the means for regulating the pressure of the air and the flow rates of the air and liquid further comprises a programmable logic controller (PLC) having programmed values for the pressure and flow rates which correspond to the desired atomization.

20. An optimized spray device as recited in claim 18, wherein the means for regulating pressure of the air further comprises:

(a) a pressure regulator means for controlling the pressure of the air, the pressure regulator means being fluidly connected to the means for supplying pressurized air to the spray applicator;

(b) an actuated control valve means for controlling the pressure and flow rate of the air, the actuated control valve means being fluidly connected to the pressure regulator means; and (c) a pressure measuring means for measuring the pressure of the air, the pressure measuring means being fluidly connected to the actuated control valve means and the spray applicator.

21. An optimized spray device as recited in claim 18, wherein the means for regulating flow rate of the liquid further comprises:

(a) a metering pump means for delivering and controlling a volume of the liquid to the spray applicator from the means for supplying the liquid, the metering pump means being fluidly connected to the means for supplying the liquid; and (b) a mass flow meter means for measuring the mass flow rate of the liquid, the mass flow meter means being fluidly connected to the metering pump means.

22. An optimized spray device as recited in claim 21, further comprising a pressure relief valve for diverting the liquid from the spray applicator, the pressure relief valve having an inlet and an outlet, the inlet being fluidly connected between the metering pump means and the spray applicator, and the outlet being fluidly connected between the means for supplying the liquid and the metering pump means, wherein the pressure relief valve opens when the pressure of the liquid reaches a predetermined pressure and closes when the pressure of the liquid drops below the predetermined pressure.

23. An optimized spray device comprising:

(a) a spray applicator;

(b) means for supplying air to a spray applicator, the air having a pressure and a flow rate;

(c) a pressure regulator means for controlling the pressure of the air, the pressure regulator means being fluidly connected to the means for supplying pressurized air to the spray applicator;

(d) an actuated control valve means for controlling the pressure and flow rate of the air, the actuated control valve means being fluidly connected to the pressure regulator means;

(e) a pressure measuring means for measuring the pressure of the air, the pressure measuring means being fluidly connected to the actuated control valve means and the spray applicator;

(f) means for supplying a liquid to the spray applicator, the liquid having a flow rate;

(g) a metering pump means for delivering and controlling a volume of the liquid to the spray applicator from the means for supplying the liquid, the metering pump means being fluidly connected to the means for supplying the liquid;

(h) a mass flow meter means for measuring the mass flow rate of the liquid, the mass flow meter means being fluidly connected to the metering pump means and the spray applicator;

(i) means for selecting a desired transfer efficiency;

(j) means for determining an optimized atomization corresponding to the desired transfer efficiency; and (k) a programmable logic controller (PLC) for regulating the pressure of the air and the flow rate of the air and liquid; the PLC having programmed values for the pressure of the air and flow rate of the air and liquid which correspond to the optimized atomization; the PLC being connected to the actuated control valve means, pressure measuring means, metering pump means, and mass flow meter means; the PLC receiving signals corresponding to pressure measurements from the pressure measuring means and signals corresponding to flow rate from the mass flow meter means; and the PLC controlling the actuated control valve means to maintain the pressure of the air equivalent to the programmed values for pressure and the metering pump means to maintain flow rate of the liquid equivalent to the programmed values for the flow rate.

24. An optimized spray device as recited in claim 23, wherein the means for determining the optimized atomization corresponding to the desired transfer efficiency further comprises:

(a) means for experimentally measuring an atomization and corresponding liquid and air flow rates for each of a plurality of air pressures while maintaining a constant liquid flow rate, producing atomization data;

(b) means for experimentally measuring a transfer efficiency for each of a plurality of air pressures while maintaining a constant liquid flow rate, producing transfer efficiency data; and (c) means for cross correlating the atomization and transfer efficiency data using the air pressures as a reference, the optimized atomization being determined from the cross-correlated data as the atomization corresponding to the desired transfer efficiency.

25. An optimized spray device as recited in claim 23, further comprising a pressure relief valve for diverting the liquid from the spray applicator, the pressure relief valve having an inlet and an outlet, the inlet being fluidly connected between the metering pump means and the spray applicator, and the outlet being fluidly connected between the means for supplying the liquid and the metering pump means, wherein the pressure relief valve opens when the pressure of the liquid reaches a predetermined pressure and closes when the pressure of the liquid drops below the predetermined pressure.

* * * * *